US006134923A

United States Patent [19]

Lay et al.

[11] Patent Number: 6,134,923

[45] Date of Patent: Oct. 24, 2000

[54] KNITTED COVER

[75] Inventors: Anthony Michael Lay, Leicester; Malcolm Frederick Proctor, Nottingham, both of United Kingdom

[73] Assignee: Lear Corporation, Southfield, Mich.

[21] Appl. No.: 09/086,222

[22] Filed: May 28, 1998

[30] Foreign Application Priority Data

Jun. 3, 1997 [GB] United Kingdom ..... 9711297

[51] Int. Cl.[7] ..... D04B 1/22

[52] U.S. Cl. ..... 66/170; 66/196

[58] Field of Search ..... 66/64, 69, 70, 66/71, 75.1, 76, 77, 169 R, 170, 179, 196, 197; 297/218.1, 218.4

[56] References Cited

U.S. PATENT DOCUMENTS

| | | | |
|---|---|---|---|
| 5,038,585 | 8/1991 | Robinson et al. | 66/170 |
| 5,275,022 | 1/1994 | Stoll et al. | 66/64 |
| 5,308,141 | 5/1994 | Robinson et al. | 297/218 |
| 5,326,150 | 7/1994 | Robinson et al. | 297/218 |
| 5,626,037 | 5/1997 | Jeffcoat | 66/170 |
| 5,711,168 | 1/1998 | Proctor et al. | 66/189 |
| 5,722,262 | 3/1998 | Proctor et al. | 66/60 R |
| 5,887,452 | 3/1999 | Smith et al. | 66/170 |

FOREIGN PATENT DOCUMENTS

| | | |
|---|---|---|
| 0 361 854 A1 | 9/1989 | European Pat. Off. . |
| 0 725 173 A1 | 1/1996 | European Pat. Off. . |
| 196 16 003 A1 | 4/1996 | Germany . |
| 1 069 812 | 5/1967 | United Kingdom . |
| 2 184 750 | 7/1987 | United Kingdom . |
| 2 223 034 | 3/1990 | United Kingdom . |
| 2 297 562 | 8/1996 | United Kingdom . |

*Primary Examiner*—Danny Worrell
*Attorney, Agent, or Firm*—Brooks & Kushman PC

[57] ABSTRACT

A knitted cover and a method of forming a two-dimensional knitting pattern for the cover. The pattern is taken from two-dimensional development of the cover and has pairs of edges-to-be-joined in the conversion from two-dimensional development to three-dimensional cover. These edges are broken down into courses or rows of progressively changing lengths, and the courses or rows are rearranged to form new edges in which a particular course or row is not necessarily adjacent its original neighbour before rearrangement.

21 Claims, 3 Drawing Sheets

KNITTED COVER

TECHNICAL FIELD

This invention relates to a knitted fabric cover and to a method of producing a knitting pattern for continuously knitting a fabric cover for a three-dimensional object, the whole cover being formed in a single operation requiring little, if any, further sewing or processing.

BACKGROUND OF THE INVENTION

The invention is useful in machine knitting on a weft knitting machine having independently operable needles disposed in at least two needle beds, for example, a flat V-bed machine producing a mainly double jersey structure. In such machines, the width of the knitted fabric is restricted by the maximum number of needles available for forming a course across the machine bed.

Three-dimensional fabric structures for covering three-dimensional objects are produced from two-dimensional material and have in the past been produced by weaving or knitting shaped parts and panels of two-dimensional material and sewing them together.

More recently, it has been found possible to continuously knit one-piece upholstery fabric, which removes the need for sewing portions together, and has the desired shape to serve as covers for the base and back cushions of motor vehicle seats; see, for example, U.S. Pat. Nos. 5,308,141 and 5,326,150. The shaping of covers is accomplished by joining together edges of areas of fabric during the knitting process so that the wales on opposite sides of the join are inclined relative to each other. When a large number of wales are joined together on a course-by-course progression, the join manifests itself as a suture line.

Suture lines, as well as being visual, may give rise to hole formation at the joins between wales on each edge. U.S. Pat. No. 5,038,585 discusses in detail the problems associated with continuous knitting of edges-to-be-joined.

SUMMARY OF THE INVENTION

Accordingly, there is provided a continuously weft knitted three-dimensional fabric cover comprising stitches arranged in wales and courses and having two adjacent areas in which the wales in one area are inclined to the wales in the other area, and wales in said one area are each connected to a respective wale in said other area through at least one stitch located in at least one course-wise repeat unit such that said stitches are scattered so that there is no detectable suture line between said areas.

A course-wise repeat unit may comprise a single face course or two face courses, i.e., two traverses of the yarn carrier on the knitting machine.

The stitches may be arranged in courses of different lengths scattered randomly according to length, or preferably arranged in a mixed but ordered fashion.

The wales in one area appear to join the wales in the other area in a gentle sweeping curve. This is achieved by mixing the stitches in sets of courses of progressively changing course length, with the different sets having course lengths that differ from set to set.

Also according to the invention there is provided a two-dimensional knitting pattern for weft knitting a three-dimensional fabric cover having stitches arranged in wales and courses and having two adjacent areas in which the wales in one area are inclined to the wales in the other area, the pattern representing the courses arranged in repeat units and wales of the knitted fabric, wherein the fabric linking said two areas is represented in the pattern as fabric having an array of edges-to-be-joined in which one-half of said array is located to one side of a designated course and the other half of said array is located to the other side of said designated course and is arranged in a similar manner, preferably in mirror image of said one half, and on each side of said designated course a line, interconnecting the innermost end of the edge adjacent the designated course to the outermost end of the edge furthest from said designated course, divides the pattern so that the area of pattern outward of said line is substantially equal to the non-pattern area inward of said line.

The designated course may comprise a knitted course.

The pattern represents stitches arranged so that each half of the array comprises sets of course-wise repeat units or courses of differing lengths. The length of the courses in each set increases outwardly from the designated course, and generally the course or repeat unit lengths in each set increase set-by-set outwardly from the designated course.

There is yet further provided a method of forming a two-dimensional knitting pattern for a three-dimensional cover having two adjacent areas with the wales in one area being inclined relative to the wales in the other area, said method comprising forming a two-dimensional development of the cover which has at least one pair of edges-to-be-joined in the conversion from two-dimensional development to three-dimensional cover, determining the wale-wise and course-wise directions for knitting with the edges being arranged about a course-line passing through the point of intersection of the edges, wherein said edges are broken down into course-wise repeat units, or courses, of progressively changing lengths and the repeat units, or courses, are then rearranged forming new edges-to-be-joined arranged in a similar or complementary manner on each side of said course-line, such that a particular repeat unit or course is not necessarily adjacent its neighbor before rearrangement.

Preferably, the courses are arranged on said one side in mirror image to the courses on said other side.

The covers made according to the invention are particularly suitable for chairs and seats, especially automobile seats in which it is particularly useful to reduce the visual impact of suture lines.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
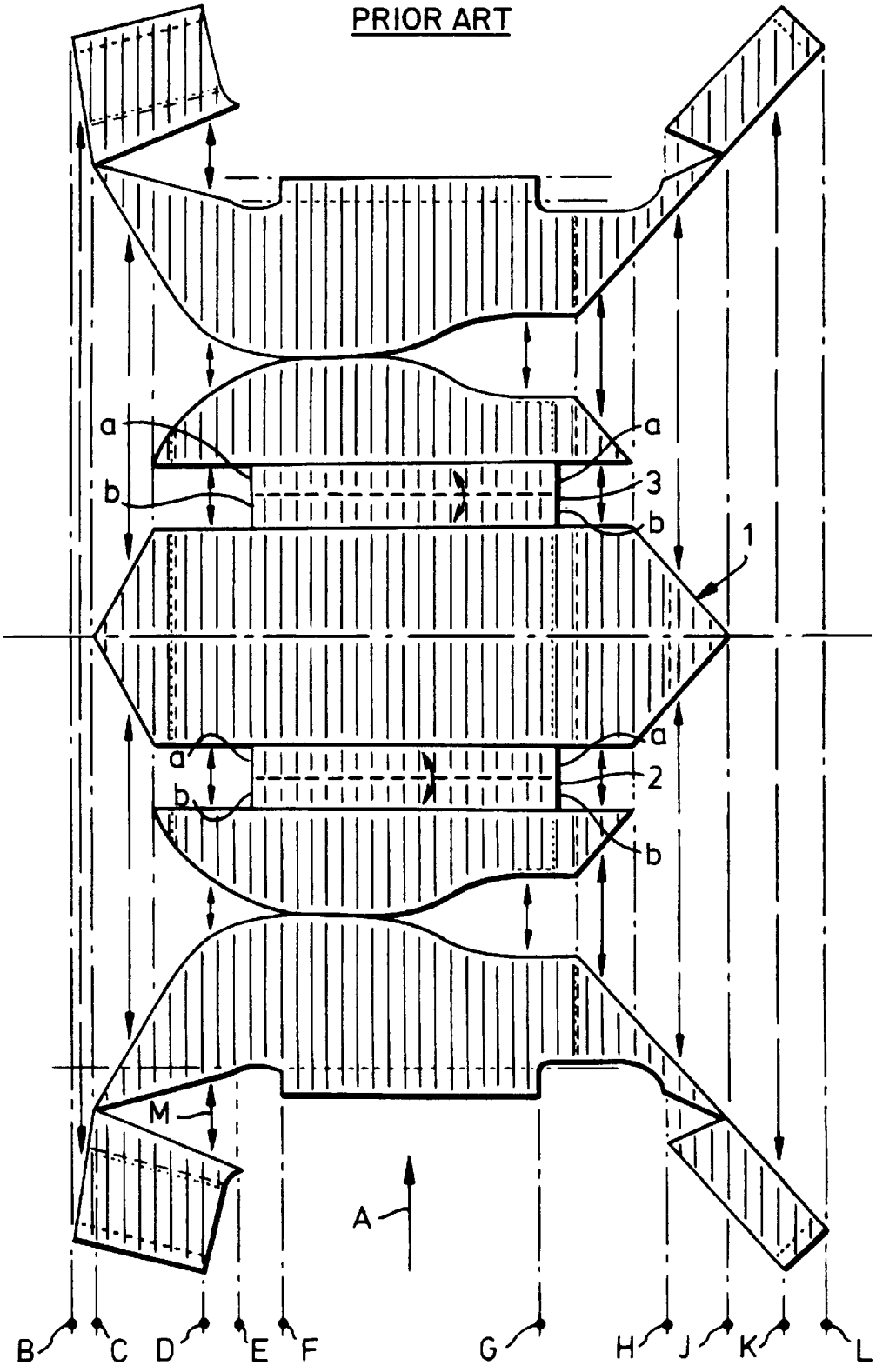
Fig .1. PRIOR ART
FIG. 1 shows a prior art knitting pattern.

FIG. 1 is a conventional pattern for a seat cover and which would be knitted in a similar manner to a cover described in U.S. Pat. Nos. 5,308,141 and 5,326,150. A fabric piece for covering a seat base of an automobile seat can be continuously weft-knitted in a single operation. The fabric piece is of mainly double jersey structure and is knitted on a flat V-bed knitting machine provided with a conventional presser foot device or other loop hold-down device for holding down the knitted fabric between the opposed needle beds of the machine. The fabric piece is knitted from a knitting pattern which is a two-dimensional development of a three-dimensional knitted fabric seat cover. The direction of knitting, indicated by arrow A, is such that the wales of the fabric piece extend in a desired manner across the seat base. This may be dictated by a pattern on the fabric or by other technical considerations.

The knitting of the fabric piece is described in detail in EP-A-0,361,855 and will only be further described herein so as to give background information for understanding the present invention.

In FIG. 1, the line B–L represents the length of opposed needle beds of the machine on which the piece is knitted. The needles operate to form fabric along vertical lines only (that is, in wales). Referring to the pattern 1, the knitting begins on a few needles at point D on the needle bed, and more needles are brought progressively into action course-by-wale in the direction from D–B and from D–E to begin to define the edges of the material. Similarly, knitting will commence at point K with needles being brought progressively into action from K–H and from K–L. The needles are then made progressively active and/or inactive in order to obtain the required shape of the fabric.

During the continuous knitting operation from bottom to top of the fabric, edges of the fabric between which double-ended arrows are located are knitted together. Taking the two edges indicated by double-headed arrows M and N, for example, this requires that needles made inactive between the point E and C, and H and J, respectively, are progressively reactivated to "join" the two edges indicated by M and N along vertical lines.

Integral open-ended pockets may be formed by knitting areas 2 and 3 on one needle bed only, or alternatively the areas 2 and 3 are utilized by folding along the dotted lines for forming open-ended pockets beneath the seat cover for facilitating incorporation of the cover into a seat.

Figure 2:
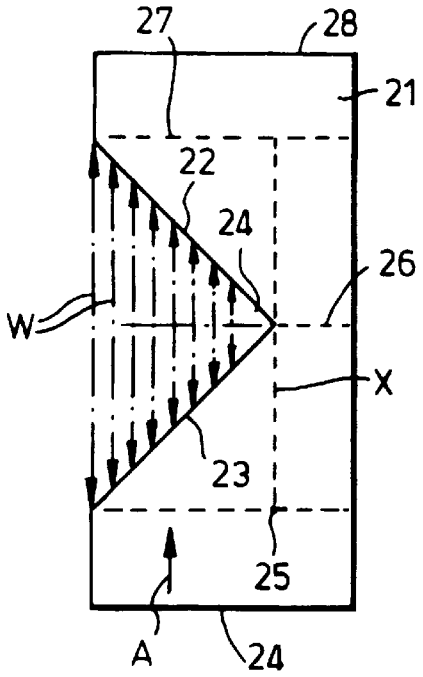
PRIOR ART Fig.2.
FIG. 2 shows an article having two edges to be knitted together according to the prior art.

Referring to FIG. 2, there is illustrated a portion 21 of conventional knitting pattern having a pair of edges-to-be-joined 22, 23 which preferably have a horizontally equally bisected angle therebetween which is preferably 90 degrees. The knitting commences at the set-up course 24 and continues on all needles up to course 25. Needles on the machine are then made progressively inactive course by course from left to right as shown up to the needleline X. This continues up to course 26. After course 26, the needles are then progressively reactivated course by course to the full width of the fabric at course 27. Knitting then continues on all needles up to the finishing course 28. The edges 22, 23 are joined together along needle lines W, that is, along the wales of the fabric.

Figure 3:
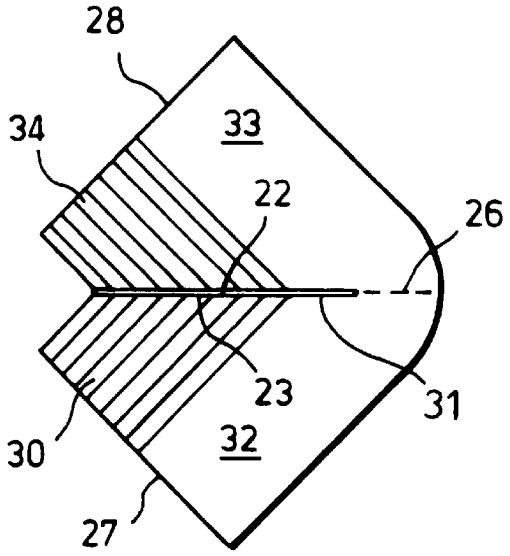
PRIOR ART Fig.3.
FIG. 3 shows the article after knitting of the edges.

The result of this operation is shown in FIG. 3. The edges 22, 23 are joined through a suture 31, thus shaping the fabric piece. The suture 31 is generally visible on both surfaces of the fabric, especially if the fabric is a jacquard construction with a regular pattern on its front face. As shown in FIG. 3, after the knitting operation the wales 30 in one area 32 are inclined to the wales 34 in the other area 33.

Figure 4:
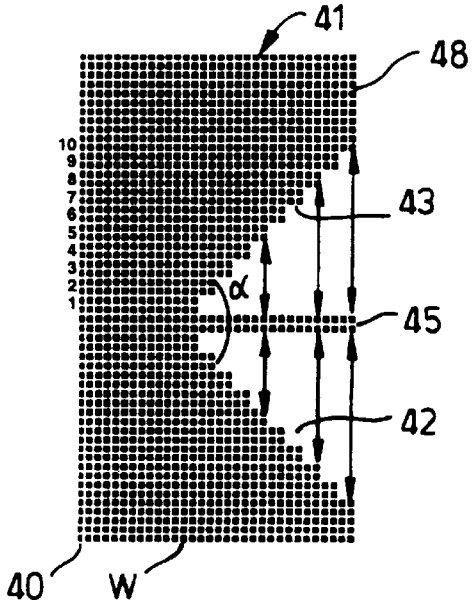
PRIOR ART Fig.4.
FIG. 4 shows another method of knitting together two edges also according to the prior art.

Referring to FIG. 4, there is shown a second prior art knitting pattern 41 which is described in detail in U.S. Pat. No. 5,038,585 in which the individual stitches are shown as shaded squares which are arranged in vertical wales and horizontal courses. The fabric is a double jersey fabric knitted in a similar manner to that shown in FIG. 2.

Knitting commences at the set-up course 40. The pattern 41 discloses edges 42, 43 to be knitted together and which comprise steps of two stitches by course and by wale. This is achieved by inactivating and reactivating needles in pairs after two courses of knitting. The main difference from FIG. 2 is the provision of a two-course wide strip 45, which may be double or single jersey knitting, located at a horizontal course-line that bisects the angle a between the edges 42, 43. As shown, the edges 42, 43 on each side of the strip 45 each comprise ten rows of two courses per row which are knitted across 18 wales. The strip 45 also extends over 18 wales and each edge 42, 43 is knitted to the strip 45 during the knitting process as indicated by the double-headed arrows.

The strip 45 helps reduce the size of holes or apertures that may occur along a suture line. The strip 45 is generally more useful where the bisected angle a exceeds 90 degrees.

Figure 6:
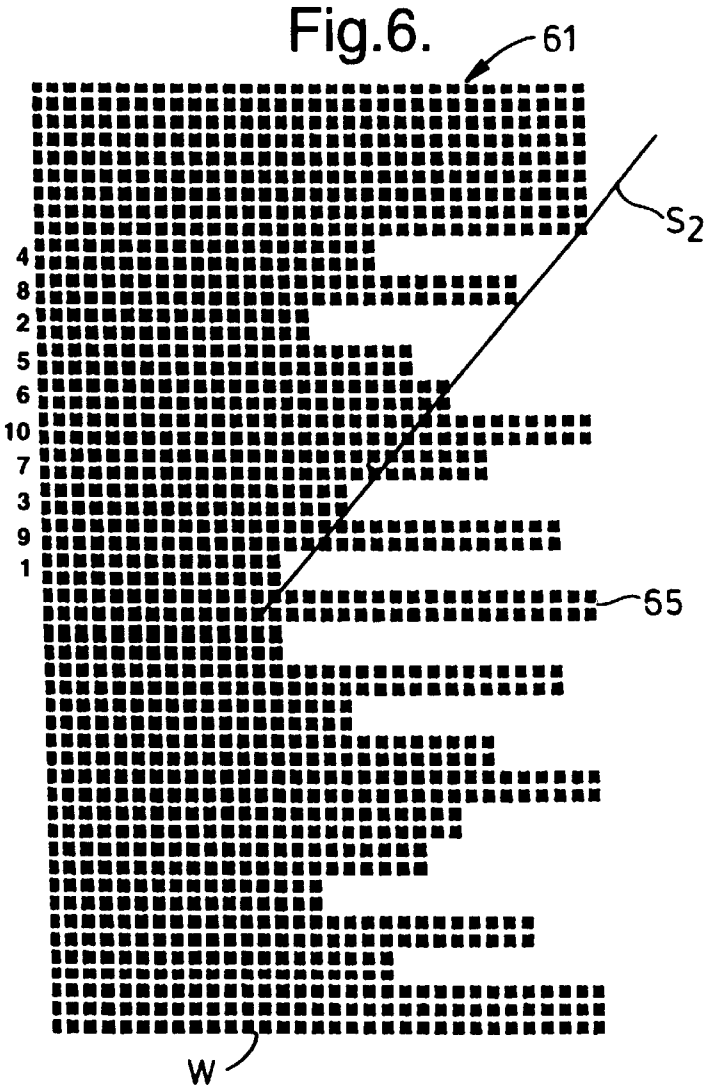
FIG. 6 is a second knitting pattern according to the present invention.
Figure 5:
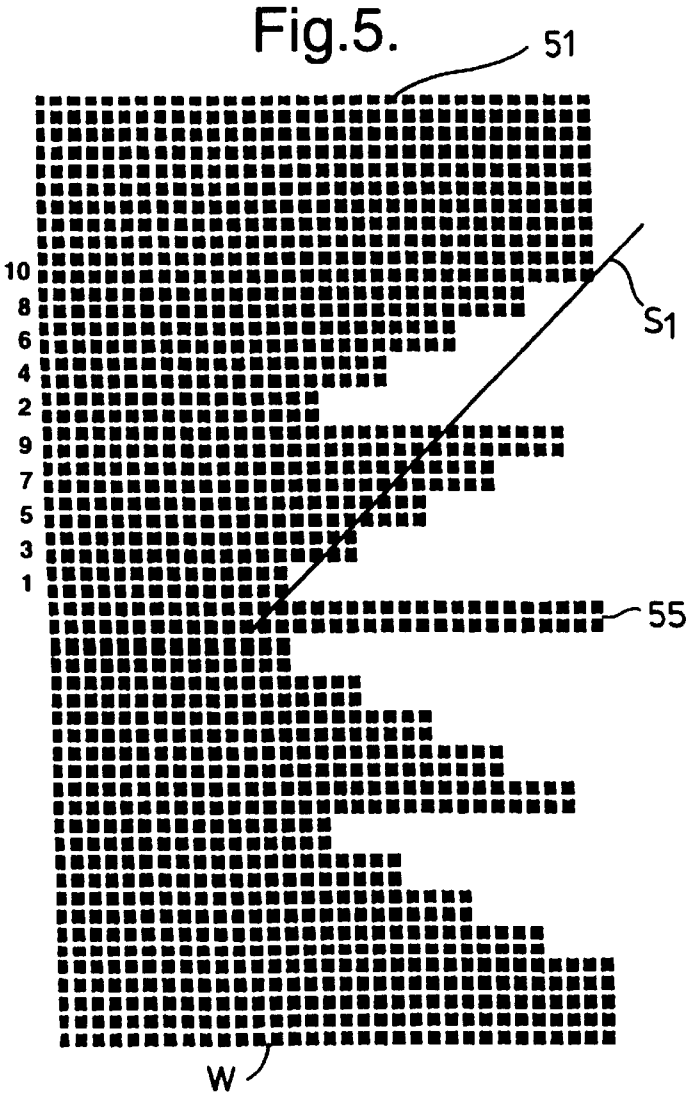
FIG. 5 is a first knitting pattern according to the present invention.

Knitting patterns 51, 61 according to the present invention are shown in FIGS. 5 and 6. Each pattern 51, 61 will, after the knitting process, produce a fabric of the same shape as the fabric shown in FIG. 4 but with no substantially visible suture.

The invention is more easily understood with reference to the prior art pattern 41 shown in FIG. 4. The two edges 42, 43 are "formed" by knitting on each side of the strip 45 ten rows of two courses per row. The ten rows each comprise two courses of the same length. The rows are labelled 1–10 and are of progressively changing lengths. Since the edge 42 is a mirror image of the edge 43, only the rows above the strip 45 are labelled.

The present invention lies in the realization that the areas of fabric surrounding the edges 42, 43 can be linked together by mixing the courses so that they no longer progressively increase in course-wise length in a wale by wale.

Referring to FIG. 6, the pattern 61 has features in common with the pattern 41. The course-wise strip 65 is equivalent to the strip 45, and there are ten course-wise repeat units labelled 1–10 above and below the strip 65 which are arranged in mirror image to each other so only the rows above strip 65 will be described in detail. The repeat units 1–10 are randomly mixed to obtain the structure in FIG. 6. FIG. 6 is, of course, only one example of a random mixing of the repeat units.

Each repeat unit is represented by two face courses, with individual stitches shown as black squares. Each course represents one direction of traverse of the cam box of a knitting machine with the cam box having two, three or four knitting systems.

If this pattern is now knitted, there is no detectable suture line since the wales in the upper portion of fabric are connected to the wales in the lower portion in a progressive manner through a number of stitches which are not aligned and when viewed seem to curve gradually into each other.

However, since a random mix may also occasionally produce the prior art arrangement of FIG. 4, the arrangement shown in FIG. 5 is preferred. The pattern in FIG. 5 still uses an optional bisecting course-wise strip 55 with the courses arranged in rows above and below the strip in such a way that the arrangements mirror each other. This strip 55 could be omitted.

The repeat units are arranged in sets such that the repeat units in each set increase in length outwardly of the strip 55.

In FIG. 5 the repeat units 1 to 10 are arranged in two sets of five. Mixing rates of five or seven repeat units per set are preferred. Mixing rates of three do not sufficiently break up any suture, and rates of four or six can lead to phasing of any design knitted into the front face of the fabric. A mixing rate of five is preferred to seven since the larger number is more difficult to handle.

The repeat units are divided into groups where the number of groups is equal to the mixing rate, and the number of repeat units in each group is given by N/X, where N is the number of repeat units constituting one-half of the suture, and X is the selected mixing rate. Hence in FIG. 5, there are five groups, each including two repeat units.

The repeat units assigned to a particular set are determined in an ordered manner. The first set comprises rows 1, 3, 5, 7, 9 from the five groups, and the second set comprises rows 2, 4, 6, 8, 10 from the five groups.

If there were 30 repeat units, these would be broken down into five groups, each of six repeat units, that is 1–6, 7–12, 13–18, 19–24, 25–30. The repeat units are then assigned to the six sets so that set 1 nearest the strip 55 comprises the first repeat units from each group, i.e., 1, 7, 13, 19, 25, and set 2, the next outer set, comprises the second repeat units from the groups, i.e., 2, 8, 14, 20, 26. This progression continues with the set z being assigned the zth repeat unit from each group, until all the rows have been assigned to the six sets.

It can be seen in each set that the sets themselves generally increase in course length set-by-set outwardly from the strip, as well as the repeat units increasing in length outwardly within each set.

This method joins together areas to shape the fabric cover without forming distinctive suture lines. The cover is more homogeneous and is more deformable since suture lines create areas of stiffness.

It will be appreciated that although the above method has been described with reference to repeat units of knitting comprising two face courses, it is applicable to single course repeats, or repeat units of knitting comprising three or four courses, largely depending upon the type of knitting machine being used.

The patterns 51 and 61 are arranged so that a straight line si or s2 on each side of the strip 55 or 65, drawn from the innermost point on repeat unit 1, adjacent the strip, to the outermost point on the tenth repeat unit, furthest from the strip, divides the edge portion so that the area of pattern to the outside of the line si is substantially equal to the area of space inwardly of the line to the edges of the pattern.

What is claimed is:

1. A continuously welf-knitted three-dimensional double jersey construction fabric cover comprising stitches arranged in wales and courses and having two adjacent areas in which the wales in one area are inclined to the wales in the other area, and wales in said one area are each connected to a respective wale in said other area through at least one stitch located in at least one course-wise repeat unit such that said one stitches are scattered so that there is no suture line between said areas.

2. A cover as claimed in claim 1 wherein said one stitches are arranged to one side and the other of a designated course so that the stitch structure on one side of said course is complementary to the stitch structure on the other side of the course.

3. A cover as claimed in claim 2 wherein the stitch structure to one side of said course is a mirror image of the stitch structure to the other side of said course.

4. A cover as claimed in claim 3 wherein said one stitches to said one side are separated from the scattered stitches to said other side by at least two courses.

5. A cover as claimed in claim 2 wherein said one stitches are arranged in course-wise repeat units of different lengths scattered randomly by length on each side of said designated course or two courses.

6. A cover as claimed in claim 2 wherein said one stitches are arranged in repeat units of different course-wise lengths and the units are mixed in an ordered manner based on sets of repeat units of progressively changing course length, the different sets having course lengths that differ from set to set.

7. A cover as claimed in claim 6 wherein each set of repeat units comprise five or seven repeat units of different lengths.

8. A cover as claimed in claim 1 wherein the cover comprises stitches knitted on a machine having 10 to 14 needles per inch.

9. A two-dimensional knitting pattern for weft knitting a three-dimensional fabric cover having stitches arranged in wales and courses and having two adjacent areas in which the wales in one area are inclined to the wales in the other area, the pattern representing the courses arranged in repeat units and the wales of the knitted fabric, wherein the fabric linking said two areas is represented in the pattern as fabric having an array of edges-to-be-joined in which one-half said array is located to one side of a designated course and the other half of said array is located to the other side of said designated course and is arranged in a complementary manner to said one-half of the array, and on each side of said designated course a line, interconnecting the innermost end of the edge adjacent the designated course to the outermost end of the edge furthest from said designated course, divides the pattern so that the area of pattern outward of said line is substantially equal to the non-pattern area inward of said line.

10. A pattern as claimed in claim 9 wherein the two halves of said array are arranged in mirror image of each other.

11. A pattern as claimed in claim 9 wherein the two halves of the array of edges-to-be-joined are separated in the pattern by two courses.

12. A pattern as claimed in claim 11 wherein said pattern represents stitches arranged so that each half of the array comprises sets of course-wise repeat units, and in each set the course length progressively increases the further the respective repeat unit from said designated course, and the course lengths in each set increase set-by-set with distance of the set from the designated course.

13. A pattern as claimed in claim 12 wherein said sets each comprise five repeat units.

14. A method of forming a two-dimensional knitting pattern for a three-dimensional cover having two adjacent areas with the wales in one area being inclined relative to the wales in the other area, said method comprising forming a two-dimensional development of the cover which has at least one pair of edges-to-be-joined in the conversion from two-dimensional development to three-dimensional cover, determining the wale-wise and course-wise directions for knitting, wherein said edges are broken down into courses or repeat units of progressively changing lengths, and the courses or repeat units are rearranged forming new edges-to-be-joined arranged complementary to each other, and a particular course or repeat unit is not necessarily adjacent its original neighbour before rearrangement.

15. A method as claimed in claim 14 wherein the edges-to-be-joined in the development are arranged symmetrically about a particular course-line prior to the rearrangement of edge courses or repeat units.

16. A method as claimed in claim 14 wherein the edge courses or repeat units are rearranged in a random manner.

17. A method as claimed in claim 14 wherein the edge courses or repeat units are mixed in an ordered manner.

18. A method as claimed in claim 17 wherein N courses or repeat units on each side of said course-line are divided progressively into groups of N/X courses or repeat units per group, where X is a selected mixing rate, the repeat units are arranged in sets S, the sets being numbered from the course-line, and each set S comprises courses or repeat units from each group selected such that S1 comprises the $1^{st}$ course of repeat unit from each group, S2 the $2^{nd}$ course or repeat unit from each group, Sz the zth course or repeat unit, etc.

19. A method as claimed in claim 18 wherein X is five or seven.

20. A knitting pattern made by a method as claimed in claim 14.

21. A cover made according to a knitting pattern as claimed in claim 20.

* * * * *